United States Patent [19]

Leroy

[11] 4,207,635

[45] Jun. 17, 1980

[54] RELAXING FURNITURE ESPECIALLY DESIGNED FOR THE VENTRAL AND/OR DORSAL DECUBITUS

[76] Inventor: Michel Leroy, 115 avenue de Fontainebleau, 77250 Veneux les Sablons, France

[21] Appl. No.: 939,234

[22] Filed: Sep. 5, 1978

[30] Foreign Application Priority Data

Sep. 6, 1977 [FR] France ..... 77 26903
Oct. 28, 1977 [FR] France ..... 77 32553

[51] Int. Cl.[2] ..... A47C 3/00; A47C 25/00

[52] U.S. Cl. ..... 5/437; 5/430; 5/62

[58] Field of Search ..... 5/60, 62, 66–69, 5/86, 91, 92, 430, 434–437, 464, 480, 500; 297/284

[56] References Cited

U.S. PATENT DOCUMENTS

| | | | |
|---|---|---|---|
| 1,045,228 | 11/1912 | Weltmer | 5/91 |
| 3,266,061 | 8/1966 | Fuechsel | 5/86 |
| 3,534,416 | 10/1970 | Ackermann | 5/91 |
| 3,717,376 | 2/1973 | Lutchausky | 5/60 |
| 3,987,504 | 10/1976 | Fox | 5/69 |
| 4,070,720 | 1/1978 | Edney | 5/92 |

FOREIGN PATENT DOCUMENTS

| | | | |
|---|---|---|---|
| 2357267 | 5/1975 | Fed. Rep. of Germany | 5/345 R |

*Primary Examiner*—Casmir A. Nunberg
*Attorney, Agent, or Firm*—Fisher, Christen & Sabol

[57] ABSTRACT

The present invention relates to relaxing furniture particularly for the ventral and/or dorsal decubitus comprising a rest surface which is substantially flat and adapted to receive the body in stretched out position and comprising, in a zone substantially situated in the upper part of its middle third, a swell which is adapted to support the periumbilical and subumbilical zones. The invention is more particularly applied to a piece of garden or beach furniture.

14 Claims, 36 Drawing Figures

Fig: 4
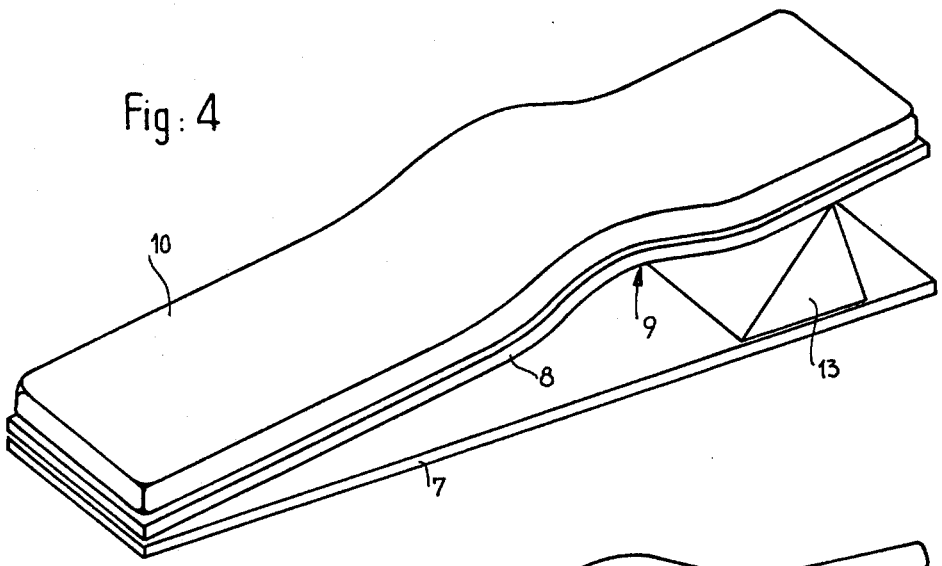
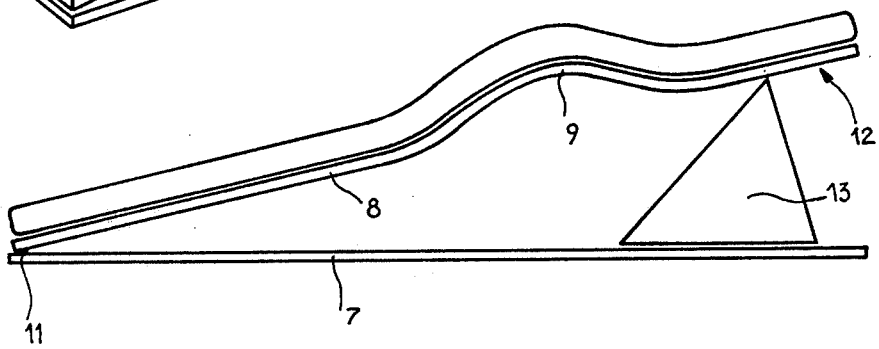
Fig: 5
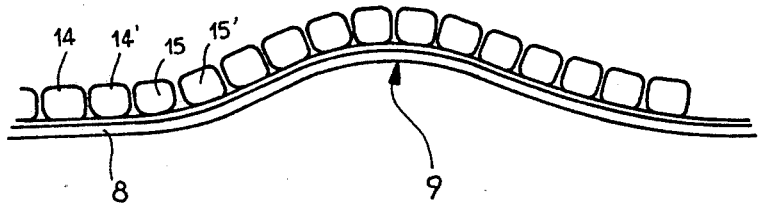
Fig: 6

Fig: 7
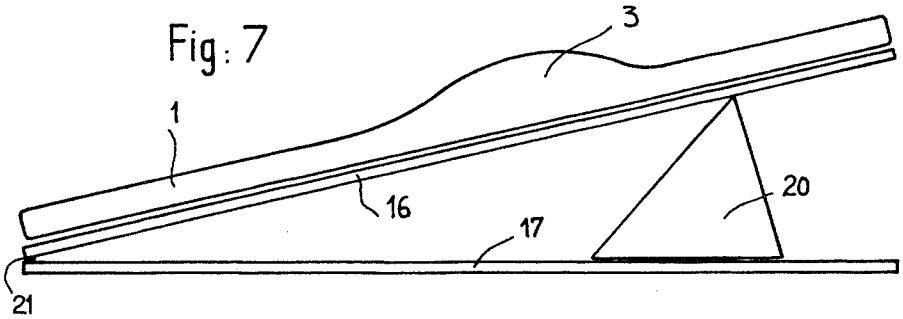
Fig: 9
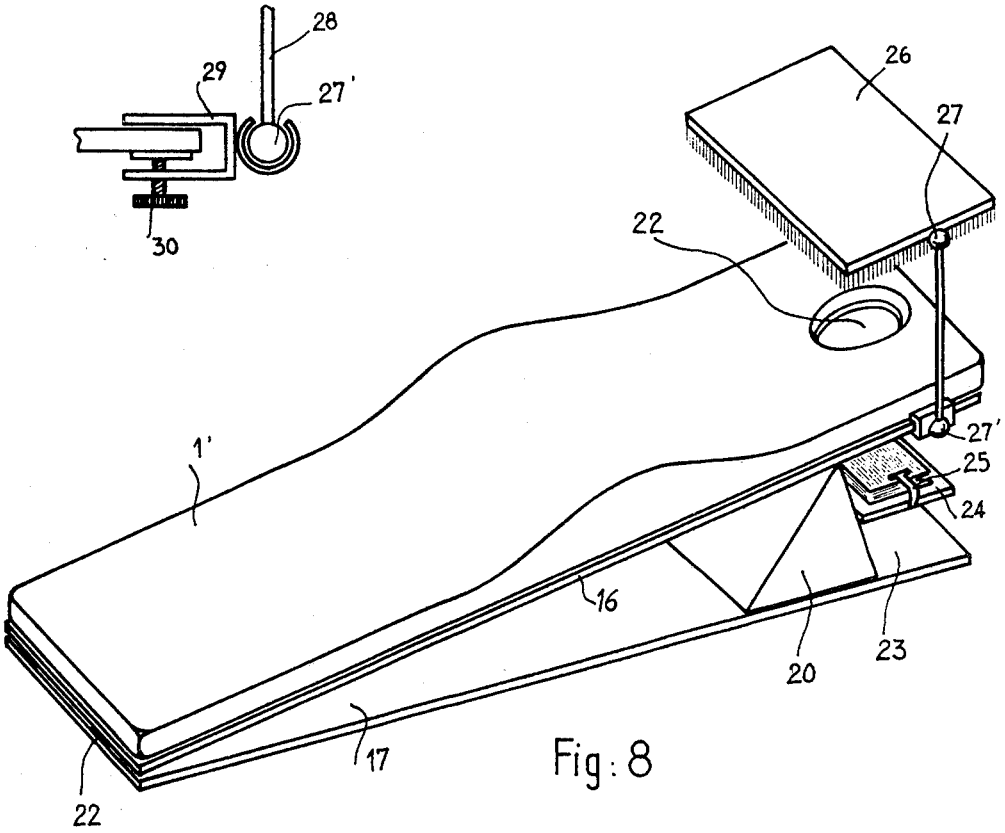
Fig: 8

Fig: 26
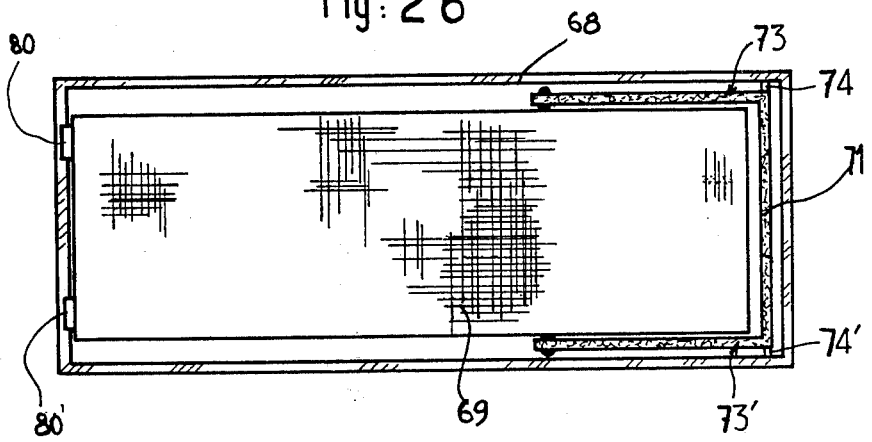
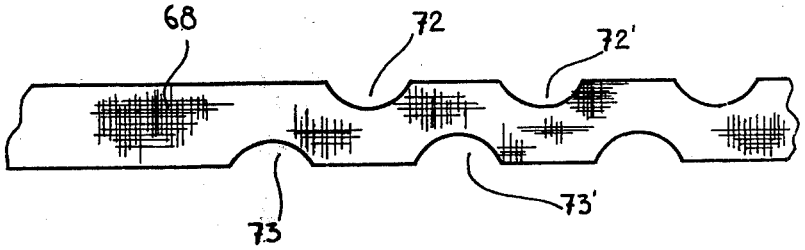
Fig: 27
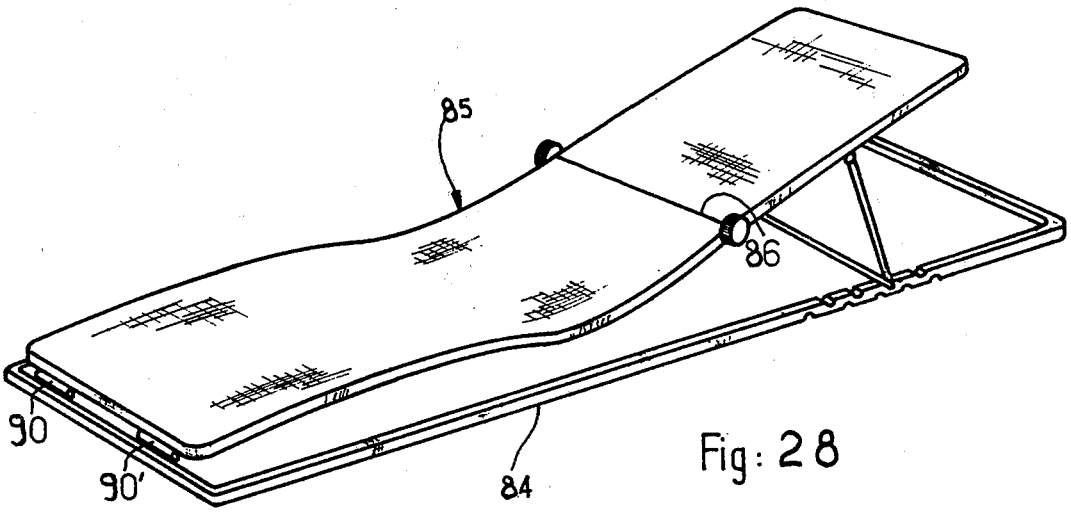
Fig: 28

RELAXING FURNITURE ESPECIALLY DESIGNED FOR THE VENTRAL AND/OR DORSAL DECUBITUS

The present invention relates to a piece of garden or beach furniture allowing a comfortable decubitus and a more intense and more rapid sun-tanning.

Curiously enough, sun-tanning adepts often adopt an uncomfortable and not very effective position in order to expose their body to the sun's rays.

In fact, a considerable number of them imagine that, even at hours remote from the mid day sun, sun-tanning can be accomplished by just stretching themselves out horizontally.

Now, the quantity of radiations received by a surface from an incidental flux is maximum when this flux is normal, and it tends towards zero when this surface is brought to a plane parallel to said flux. Moreover, particularly in order to permit reading, the position in ventral decubitus is often modified by leaning on the forearms and straightening the upper part of the body. It is certain that this position is more favourable in order to sun-tan the top of the back. But apart from the fact that it does not change the poor exposure of the lower limbs and of the lumbar region, it is particularly uncomfortable since it concentrates all supporting efforts on the elbows, hence an isometric contraction of the triceps brachii, which represents a considerable muscular effort, and above all because it involves maintaining the body in hyperlordosic position, which is often the cause of lumbar pains.

The piece of furniture which constitutes the subject matter of the present invention, aims at avoiding these inconveniences:

- in the first place, by maintaining the whole of the body in a plane which is perpendicular to the sun's rays or in a plane which approximates to them more than the horizontal plane, this resulting in an increase in the dose of radiations received (or in reducing the time of exposure necessary to obtain a dose equal to that received in a horizontal position); a further result is that it regularly distributes the weight of the body, hence the first reason for feeling comfortable;
- in the second place, by compensating very slightly the lumbar lordosis by an inverse convexity (upward) of the corresponding part of the surface of the decubitus, which results in avoiding the lumbar pains caused by the posture in hyperlordosis and, consequently, having a feeling of well-being and of relaxing, which makes it possible to remain in this position for as long as one desires.

The present invention relates particularly to furniture for relaxing, such as a piece of garden or beach furniture, allowing a comfortable decubitus, which is characterised in that it comprises a rest surface having at least in a zone situated substantially in the upper part of the middle third thereof, a swell which is adapted to support the periumbilical and subumbilical zone; this swell can be undeformable or variable in its curve, the parts of the rest surface under and above this swell being able to be flat or slightly curved, located in the same plane or in planes which are a few centimeters away from one another, parallel planes or planes which are slightly divergent from one another, the different angular values thus defined being constant or variable.

According to another feature, the present invention also relates to relaxing furniture, characterised in that it is constituted by a base, a rest surface adapted to receive the body in a stretched out position, said rest surface being pivoted by one end on said base and by at least one connection member between the base and the said rest surface adapted to allow the inclination of the rest surface to be adjusted with respect to the base.

According to another feature, the invention also relates to a relaxing furniture allowing a comfortable decubitus both in the ventral and dorsal position, characterised in that the face opposite the said surface presents a hollow zone complementary of said swell, and in that said furniture comprises means enabling the surface to be turned over so as to allow its use for the dorsal decubitus, the concavity of said hollow zone then facing upwardly.

Further characteristics and advantages of the invention will appear from the following description given in connection with different embodiments presented by way of non-limiting examples.

FIG. 4 represents a second embodiment of the invention, constituted by a support of invariable shape and combined with a covering mattress, the whole in perspective view.

FIG. 5 represents the supporting device of FIG. 4 in side elevation.

FIG. 6 represents a view in longitudinal section of the mattress, combined with the supporting device of the preceding figures.

FIG. 7 represents another variant embodiment of the present invention.

FIG. 8 represents a more elaborate embodiment, which combines different accessories with the supporting device.

FIG. 9 represents a view in detail of the fixation of the canopy combined with the supporting device as shown in FIG. 8.

Figure 25:
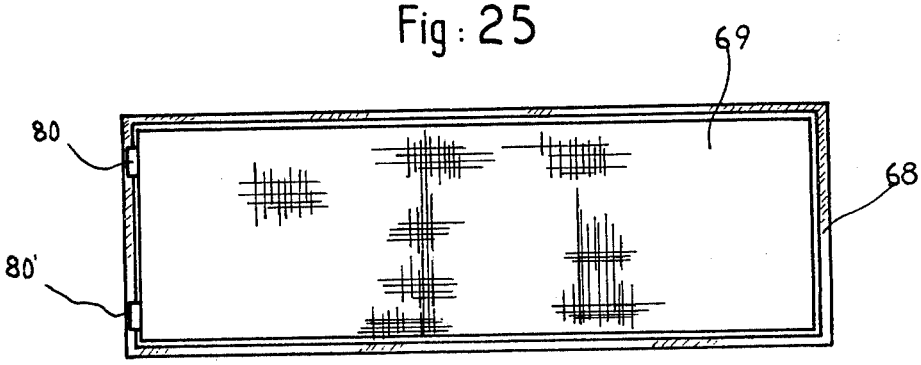

FIG. 25 corresponds to a plan view of this embodiment, when there is no inclination of the rest surface.

FIG. 26 corresponds to a plan view of another variant of this embodiment, when there is no inclination of the rest surface.

FIG. 27 shows a side view of the distal part forming double rack of one of the longitudinal members of the frame forming base of the same embodiment.

FIG. 28 shows a perspective view of a variant embodiment comprising articulations between the curved portion and the zone supporting the top of the body.

Figure 29:
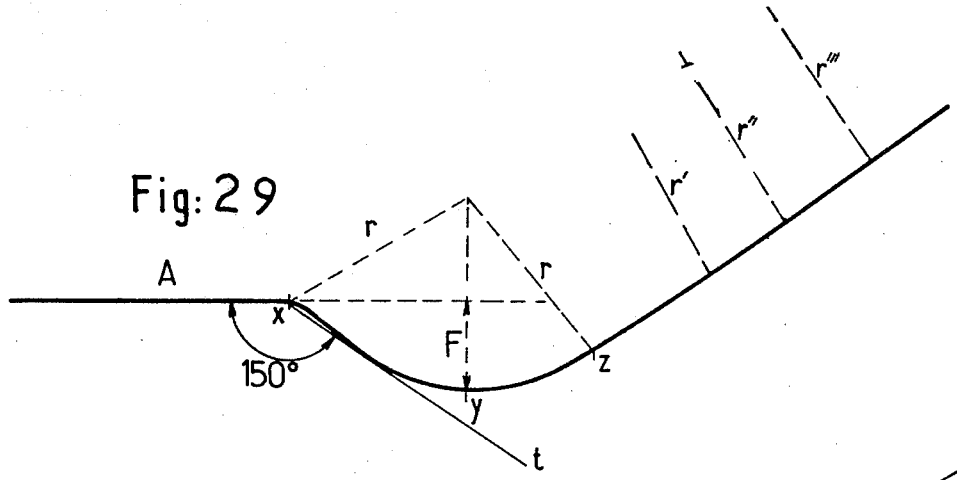

FIG. 29 shows the main feature of the curvature of the face adapted for dorsal decubitus.

Figure 30:
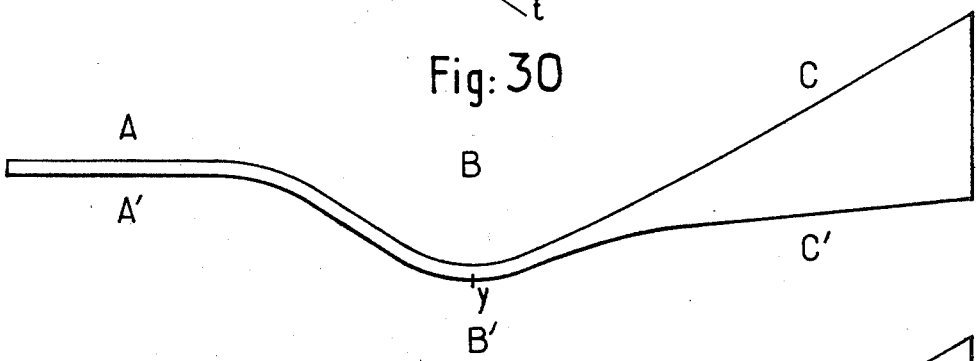

FIG. 30 shows a side view of a variant, of which the two faces which are not totally parallel, have different curvatures, one adapted to the ventral decubitus, the other to the dorsal decubitus.

Figure 31:
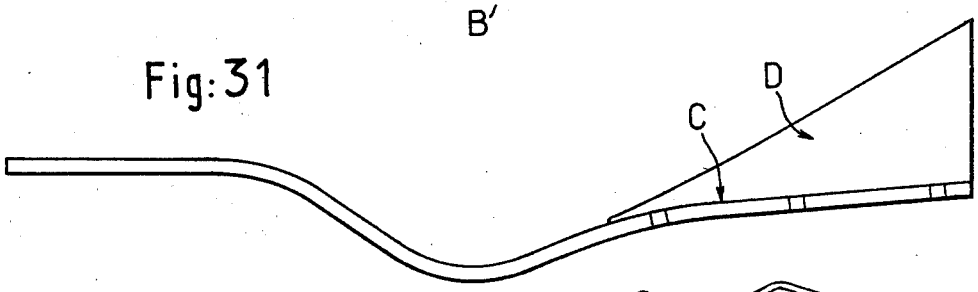

FIG. 31 shows a side view of a variant of which the totally parallel faces are modeled according to the section adapted to the ventral decubitus, a cushion being adaptable to the upper part of the dorsal decubitus face to reestablish the section described in FIG. 29.

Figure 32:
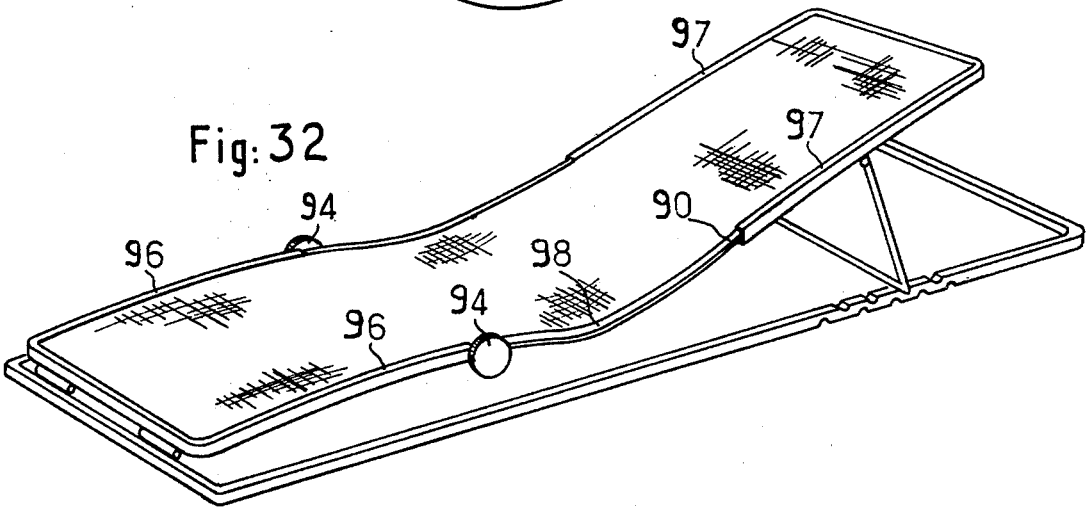

FIG. 32 shows a perspective view of an embodiment comprising a flexible median curvature which may be reversed.

Figure 33:
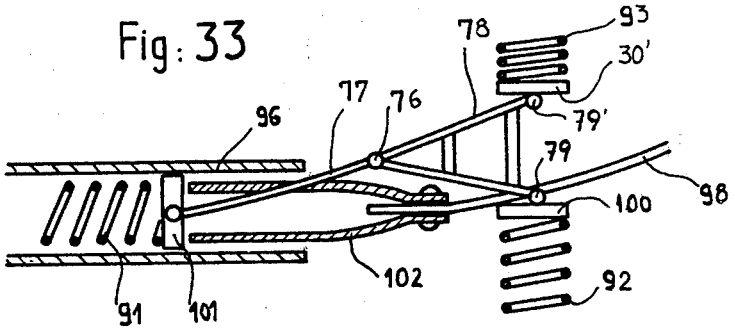

FIG. 33 shows a schematic view of an embodiment of a mechanism for reversing this flexible curvature, in convex position of this curve.

Figure 34:
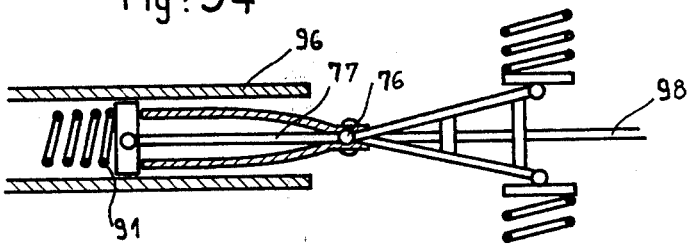
Figure 35:
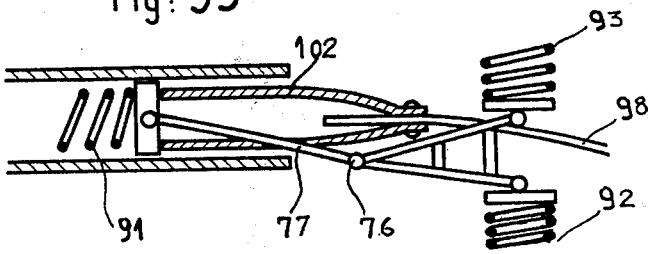

FIGS. 34 and 35 show the same mechanism in horizontal and concave position, respectively, of said curved portion.

Figure 36:
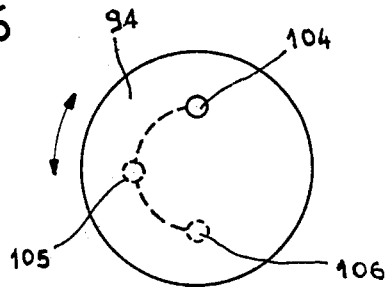

FIG. 36 shows the semi-circular stroke of the lever and the axis of this mechanism along a slide provided to this end.

Figure 1:
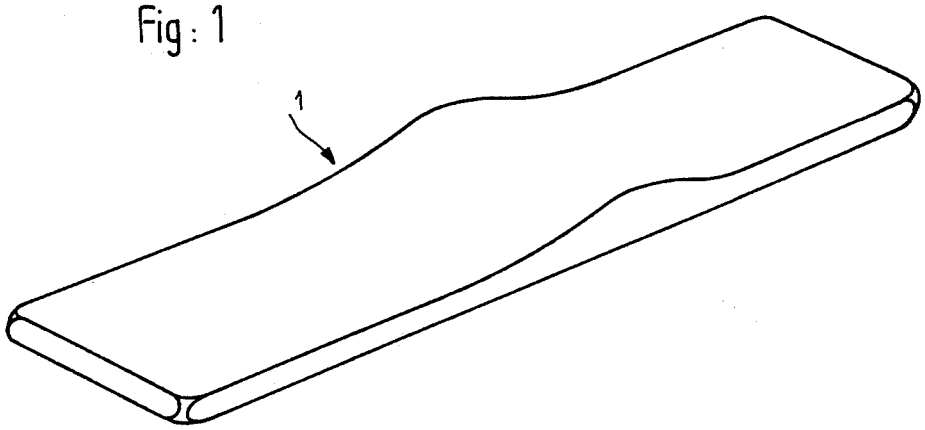
FIG. 1 represents a view in perspective of a first embodiment of the invention constituted by a mattress curved in the subumbilical region.
Figure 2:
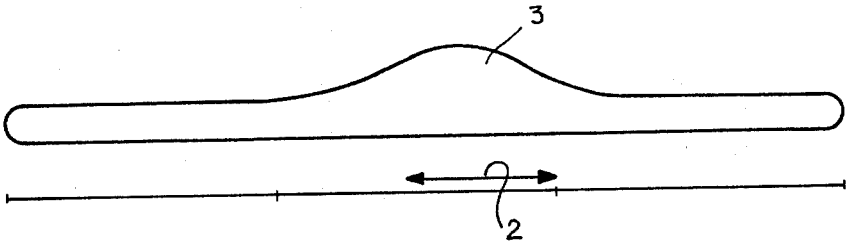
FIG. 2 represents a view in side elevation of the mattress of FIG. 1.
Figure 3:
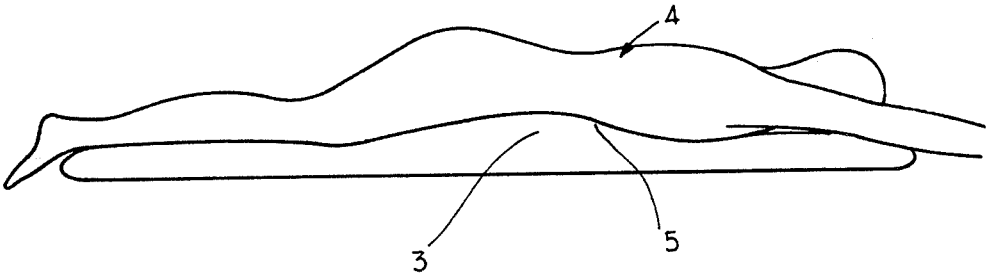
FIG. 3 represents the mattress of the preceding figures, supporting a user in the ventral decubitus position.

FIGS. 1, 2 and 3 show a first embodiment of the present invention, in which the support consists of a unitary mattress, composed for example of an elastically compressible material, in order to assure the comfort of the user.

The mattress 1 comprises in zone 2, corresponding to the upper part of the middle third thereof, a swell 3 of curved form and allowing the subumbilical and periumbilical parts to rest.

As can be seen in FIG. 3, the supporting device permits a ventral decubitus of the user 4, of whom the periumbilical part of the abdomen 5 is supported and in rest position on the excresence 3.

FIGS. 4, 5 and 6 represent a variant in which the supporting device consists of a lower base 7 combined with a rigid element 8 of a shape which is substantially flat, but which comprises in the zone corresponding to the upper part of the middle third a curve 9, which fulfills the same role as the swell 3 in the preceding figures. A mattress 10 of known type can advantageously be placed on this rigid element 8.

The support plane 8 is pivoted by one end 11 on the corresponding end of the base 7.

The opposite end 12 may thus pivot with respect to the articulation 11 and allow different and varying angular positions of the support plane 8 with respect to the base 7, which rests on the ground. A system of props may advantageously be provided between the rest surface 8 and the base 7, in order to assure the stability of the rest plane in a defined angular position corresponding to the position desired by the user, particularly in order to obtain a more advantageous exposure to the sun.

This prop system may advantageously consist of a prismatic block 13 of triangular section, which can be moved forwards and backwards along the base 7, in order to adjust the angular positioning of the rest surface 8.

Moreover, the triangle is provided with three unequal sides, so that, by using one or the other of said sides as face supported on the base 7, the user can consequently regulate the height of the rest surface 8 and its angular position with respect to the base 7.

FIG. 6 represents a view in longitudinal section in detail of a mattress which has been adapted particularly well to the rest surface 8. In order to enable the mattress to follow the shape of the curved section 9 of the rest surface 8, it has been provided for the mattress to consist of a succession of unitary elements which are placed parallel to one another and perpendicularly to the longitudinal axis of the rest surface; these unitary elements 14,14', 15 and 15' consist of prisms of quadrangular section.

According to a variant, at least in the zone corresponding to the curve 9, the unitary elements which constitute the mattress, will consist of prisms of trapezoidal section of which the larger base is turned upwards; this will allow the succession of prisms to fit perfectly with the curve 9.

FIG. 7 respresents a variant, in which the rest plane or surface 16 consists, like the base 17, of a flat surface. These two planes are articulated to each other by one end at 21 and, at their opposite end, are maintained apart from each other by means of a shore system consisting of a triangular prismatic block 20 as described above.

On the upper flat rest surface 16 is provided the mattress 1, provided with a swell 3, such as described in FIGS. 1, 2 and 3.

FIG. 8 shows another embodiment, substantially identical to the one described in FIG. 7, but which has been provided, on the end of the rest surface opposite the pivot 21, with an opening or break in continuity 22, made both in the supporting board and in the mattress 1.

This arrangement enables the head to rest essentially on the forehead, and possibly on the chin, and even on the cheek parts. This particularly allows the user to lie on the rest surface according to the invention, for a long time, under very comfortable conditions, while reading a document (book, magazine, newspaper) placed on the upper side 23 of the base 17, plumb with the opening 22; the documents read are in fact perfectly visible and at a suitable distance, through the opening 22. A device 24, serving as a bookrest, with a system of clips 25, intended to keep the pages in place, may advantageously be provided on the end 23 of base 17.

By way of complementary accessories, it is possible to provide a canopy 26, which can be positioned, as indicated in FIG. 9, by means of the ball and socket joints 27, 27' and the support rod 28, associated with a fixation clip which can be adapted by a regulating screw 30 on the edge of the rest surface 16.

Figure 10:
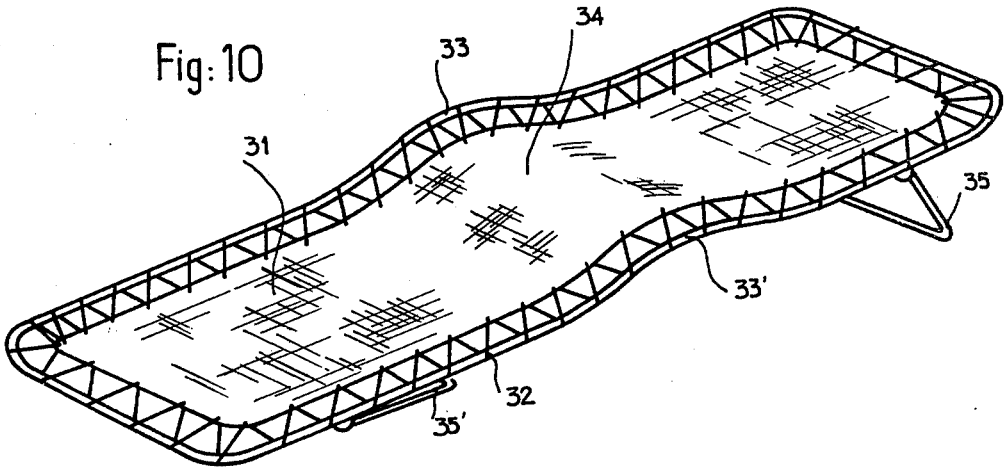
FIG. 10 represents a view of another variant embodiment of the present invention.

FIG. 10 represents a variant in which the rest surface has been made of a supple material, such as cloth 31, stretched inside a peripheric framework 32, provided, in the upper part of its middle third, with upward swell 33, 33' giving the cloth 31 stretched on the framework, a swelling movement 34.

U-shaped legs 35, 35' of known type may be associated with the framework which enable, as shown in the figure, the support to be placed in an inclined position by using only one of the legs 35, the other leg lying flat.

Figure 11:
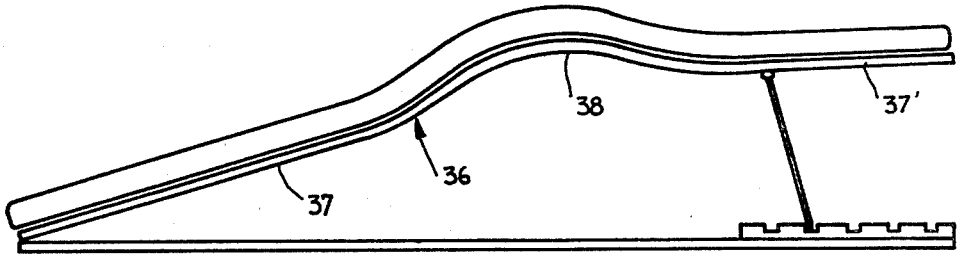
FIG. 11 represents a view in side elevation of another variant.

FIG. 11 represents a variant in which the rest surface 36 has a section, in which the two substantially flat parts 37, 37', situated on either side of the curve or swell 38, are not situated in the same plane.

Figure 12:
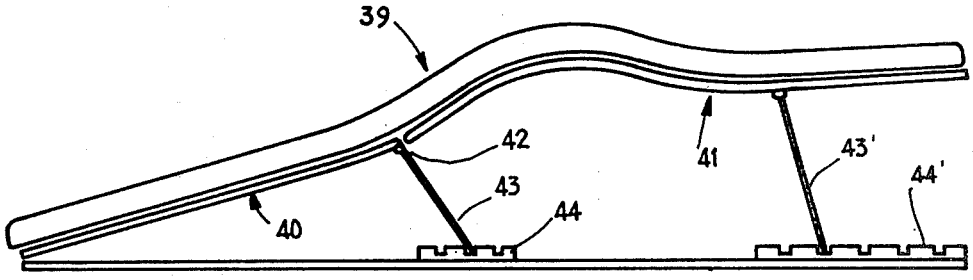
FIG. 12 represents another variant.

Another variant, derived from the preceding one, is represented in FIG. 12; the rest surface 39 is composed of two separate elements, viz. a first element 40 corresponding to the flat part 37 of the preceding figure, and a second element, which corresponds to the curve 38 and the flat part 37' of the preceding figure.

The element 40 and 41 are articulated to one another at 42.

A system of shores 43 and 43' allows each of the elements to be positioned at a suitable angle with respect to the other, whilst assuring the stability of the whole. Under these conditions it will be possible for the user to regulate the angular positioning of the elements as he wishes, and to obtain a position which is extremely comfortable, both from the point of view of his individual morphology and from that of the particular circumstances.

Shores 43, 43' are engaged in rack systems 44, 44' of known type.

Figure 13:
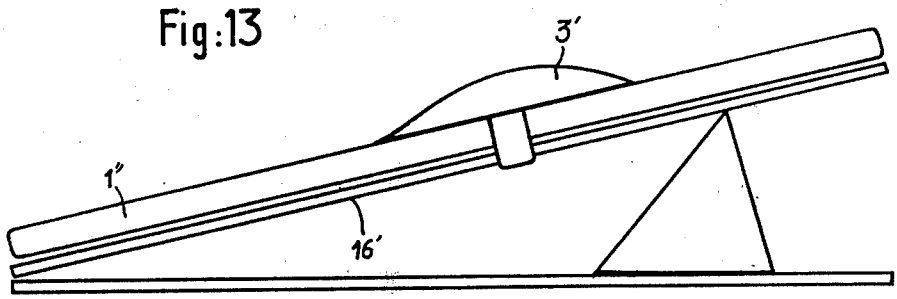
FIG. 13 represents a further variant.

FIG. 13 shows a variant which is derived from the preceding one, in which the rest surface 16' and the mattress 1'' are flat, and in which the curved section 3' is made by the addition of a supple and removable element, which may be fixed, by means of attachment systems of known type, in the region chosen by the user and better determined by him with regard to his individual morphology.

Figure 14:
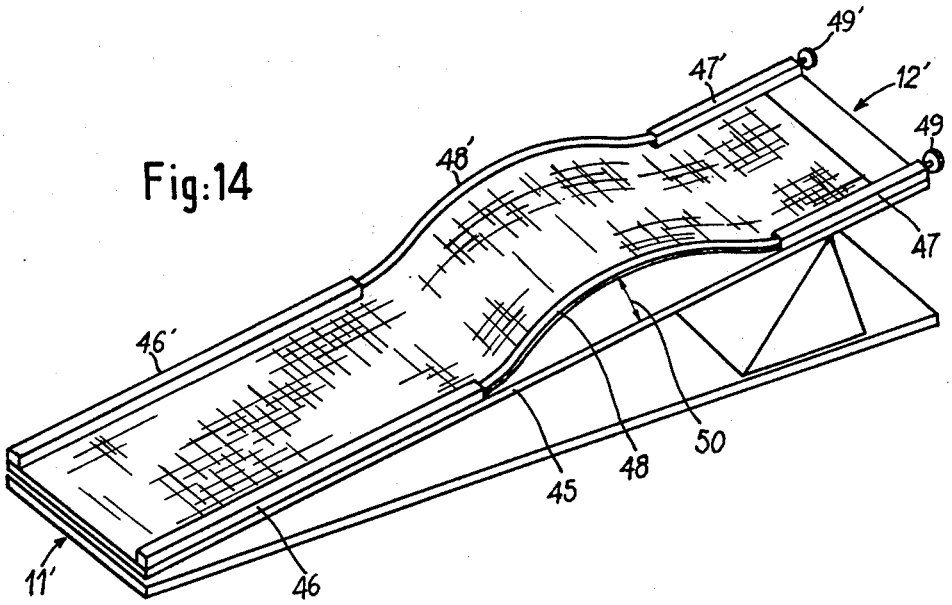
FIG. 14 represents a further variant of the present invention.

FIG. 14 shows a variant, in which the rest surface has been realised by means of a framework 45, of which the longitudinal members have guides 46,46', 47 and 47', along which can slide the flat parts of the longitudinal members of a second framework 48 and 48'. The latter are curved at the level of the upper part of their middle third and consist of an element having their qualities of flexibility, elasticity and mechanical resistance, as offered by a steel plate in such a way that the ends 11' and 12' of the second framework, compressed by a system of variable compression, such as the screws 49 and 49' or any other known system, shorten the length of the second framework, this resulting in the proportional increase of the camber 50 or the curved part. In this embodiment, a variable profile of the decubitus surface is achieved, which is extremely easy to adjust and immediately adapted by the user to his own personal morphology and to the degree of lumbar support which he desires to have.

Figure 15:
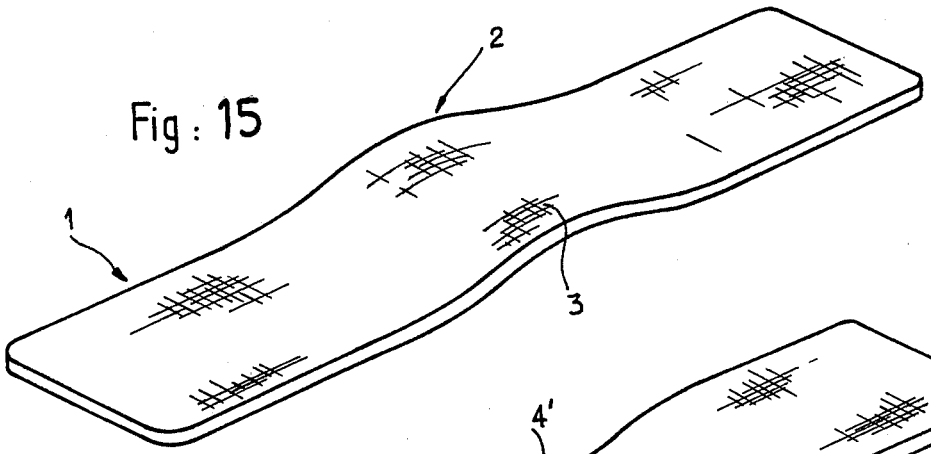
FIG. 15 shows a perspective view of a curved form for the ventral decubitus.
Figure 16:
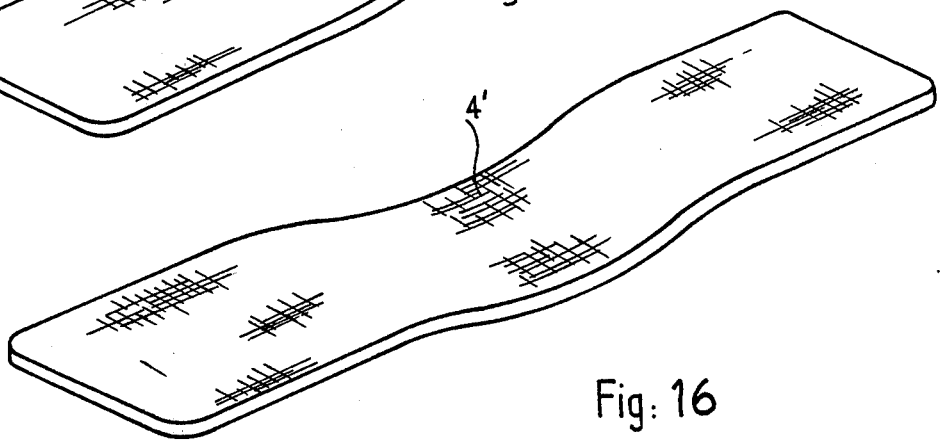
FIG. 16 shows a perspective view of the same form turned over for the dorsal decubitus.

FIGS. 15 and 16 show the basic principle of a reversible plane 1, curved in its middle part 2 so that, according to its position, it presents either a convexity 3 (FIG. 15) or a concavity 4' (FIG. 16), the user having to turn the furniture over to pass from one mode of decubitus to the other.

Figure 17:
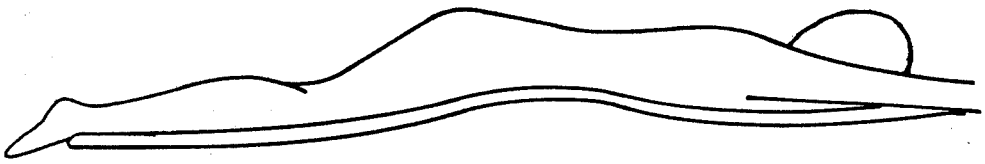
FIGS. 17 and 18 show such forms with their user, a comparison thereof indicating the shifting of the position of the body caused by the passage from one of these positions to the other.
Figure 18:
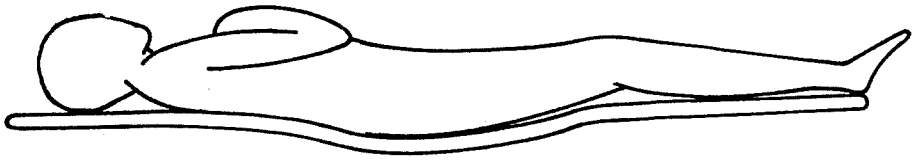
Figure 19:
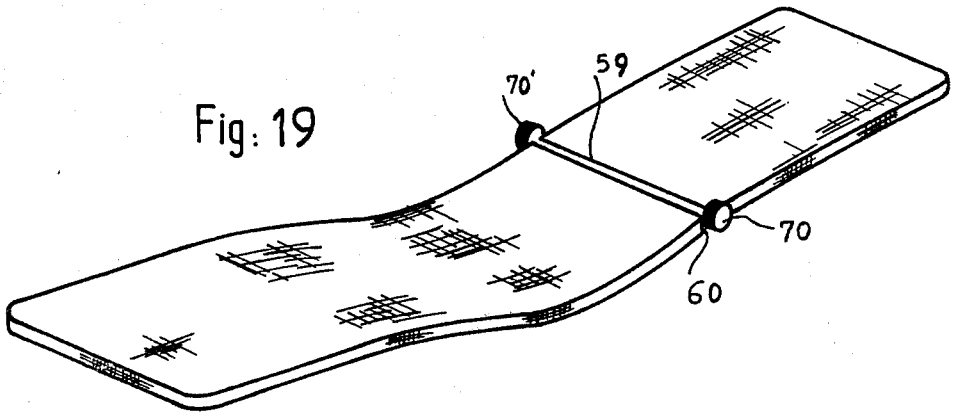
FIG. 19 shows a further embodiment of the invention, in which the part intended to support the top of the body is pivoted with the curved part, in one of its possible positions for the dorsal decubitus.
Figure 20:
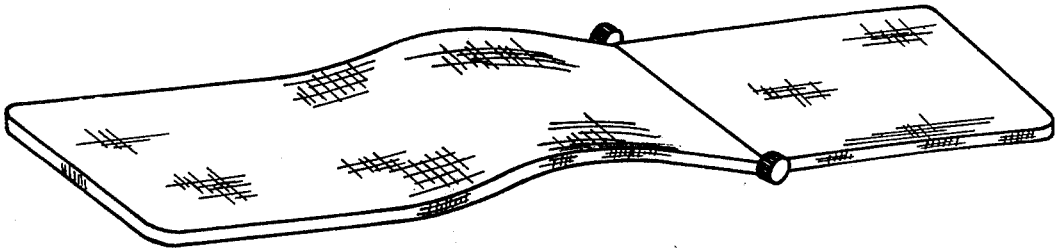
FIG. 20 shows this same embodiment of the invention in one of its possible positions for the ventral decubitus.
Figure 21:
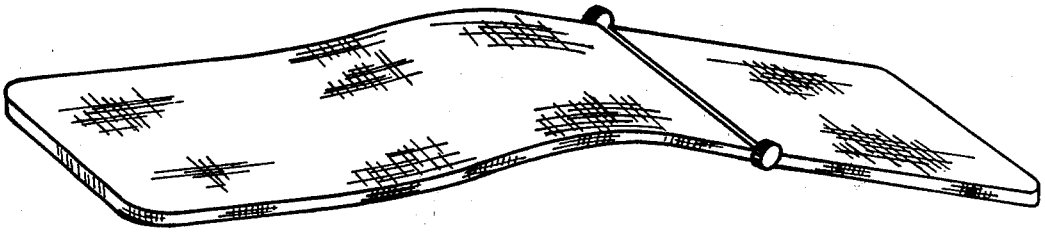
FIG. 21 shows the same embodiment of the invention in another of its possible positions for the ventral decubitus.
Figure 22:
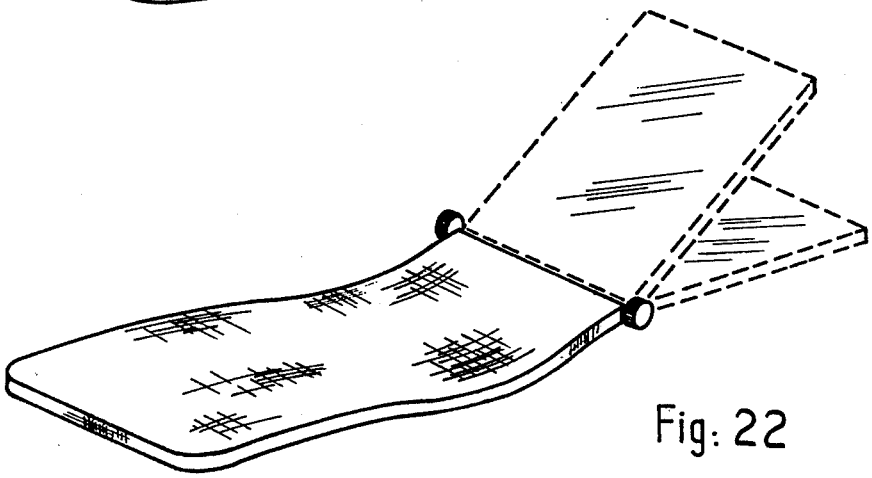
FIG. 22 illustrates the possibility of giving several inclinations to the upper part of this embodiment.

FIGS. 17 and 18 show the shifting by about twenty centimeters of the body between the two decubitus positions. This should be taken into account when determining the total length of all the variants of this reversible furniture for dorsal and ventral dedubitus.

FIGS. 19–22 show a variant pivoted at 59 by means of a disconnectable friction locking system 60 of known type presenting several possible positions both in ventral decubitus and in dorsal decubitus.

The locking system is manoeuvred by knurled knobs 70,70'. The angular variations may be greater and consequently the different positions possible more numerous for the dorsal decubitus, this allowing passage from the dorsal decubitus to the half-sitting position. The angular variations will be reduced for the ventral decubitus, the limits being the risk of hyperlordosis in one direction, the too great declivity of the upper part of the body in the other direction.

Figure 23:
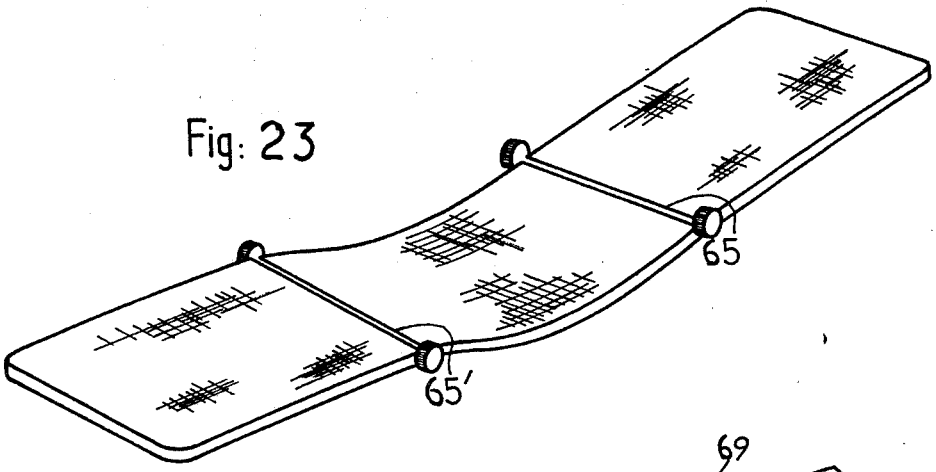
FIG. 23 shows a further embodiment of the invention comprising articulations on either side of the curved portion.

FIG. 23 shows a variant articulated about axis 65 on the one hand and 65' on the other hand.

Figure 24:
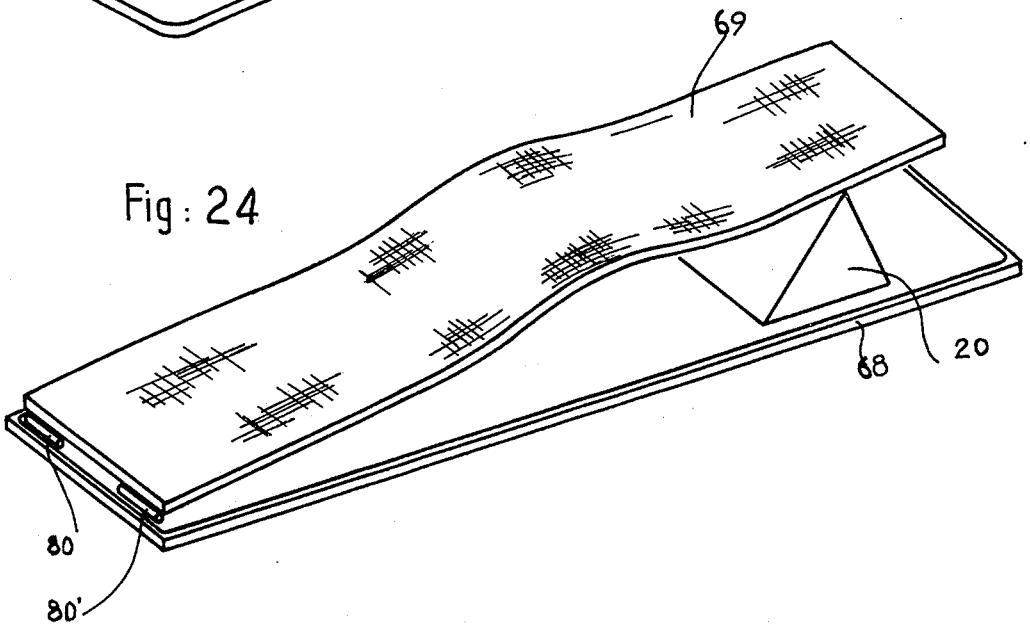
FIG. 24 shows a view in perspective of a further embodiment of the invention.

FIG. 24 shows a variant having a frame forming a base 68 of dimensions very slightly greater than those of the rest surface 69, on which it is pivoted at 80 and 80', this enabling it to pass from one side to the other.

FIG. 25 shows more particularly the relative dimensions of this frame 68 and of the rest surface 69, and the advantage of this arrangement which enables the user to turn the system over to pass from dorsal position to ventral position and vice versa. Such a device requires at least one system of connection between the two above-mentioned parts, ensuring the support of the rest surface, its possible inclination and the variations of this inclination; this system of connection may be of the type already known, constituted by a U-shaped hoop 71 (FIG. 26) pivoted by the end of the arms of the U on the rest surface and abutting, by the transverse web of the U, on the base frame. The sole condition remains in the dimensions and disposition of this support hoop enabling it to pass from one side of the rest surface to the other, in the same way as the base frame.

FIG. 26 illustrates this necessary condition relative to the reciprocal dimensions of the rest surface 69, the supporting and connecting hoop 71 and the base frame 68. This hoop will comprise at the bottom of the side arms 73, 73' retractable stops 74,74' which, in active position, abut on the notches 72,72' or 73,73' in the frame members 68 (FIG. 27).

One of the features of the reversible furniture for ventrodorsal decubitus is that the longitudinal members of the base frame have an anchoring system on their two lower and upper faces, this being rendered necessary due to the reversible use of the assembly.

FIG. 28 shows a variant comprising a base frame 84 pivoted at 90 and 90' on a curved rest surface 85, of which the reciprocal dimensions are such that the first may pass on either side of the second, said latter being pivoted at 86 and lockable by means of a disconnectable friction system manoeuvred by knurled knobs of known type, giving various angulations adapted to the dorsal decubitus on the one hand and to the ventral decubitus on the other hand.

FIGS. 29,30 and 31 show a variant having sections which are particularly suitable for the reversible use on the two faces. According to an appropriate form, which is shown in FIG. 29, in position for dorsal decubitus, the concave face facing upwardly, this curvature comprises a camber F limited to a value of between about 10 and 20 cm. The section provided for the dorsal decubitus therefore comprises a lower, substantially flat part A, which is followed by the curvature B, substantially symmetrical with respect to its point of inflection y, from x to z. The angle formed by the tangent t touching the centre of the arc x–y and the mean plane of the surface A may advantageously be in the vicinity of 150°. Beyond z, the curvature of the upper part C of the rest surface tends to be annulled progressively, then allowing progressively larger radii r',r'',r''', etc.

The section of the other face of this rest surface used for the ventral decubitus is parallel to what has just been defined, both at the level of the lower part A' and at the level of the contiguous part of the median curve B' as shown in FIG. 30. At y', or a few centimeters further, this second section no longer remains parallel to that of the dorsal decubitus, so that the part C' is located on average in a plane substantially parallel to that of the surface A' or diverges therefrom only by a few degrees. The purpose of this section is to prevent too great a declivity of the top of the body in ventral decubitus position, which declivity would bring about the parallelism of the surface C' with respect to the section described for the other face C.

The divergence of the upper parts of the two faces leads to a gradual upward thickening of the whole of the rest surface, as shown in FIG. 30. To avoid this reversible furniture for dorsoventral decubitus being cumbersome, the rest surface may be produced, as shown in FIG. 31, in the section for ventral decubitus which has just been described, a cushion D, whose thickness increases progressively upwardly, being adaptable on the upper part C of the face reserved for dorsal decubitus, and thus reestablishing the general curvature initially described for this position. In addition to its small dimensions, this embodiment, of constant thickness, its removable cushion being disregarded, presents the advantage of being able to comprise a break in continuity near its upper end allowing a frontal support of the head and facilitating reading in ventral decubitus, the removable cushion totally obturating this hole for the dorsal decubitus.

FIGS. 32–36 illustrate a variant in which the reversibility of the furniture is obtained, not by turning it all over, but by the reversible inversion of the curvature of its curvature of its curved part. The furniture comprises, in addition to a base and a connecting element such as those described previously, a rest surface constituted by a frame 96,97. The segments of the longitudinal members 96,97 form slides in their internal part; due to their tubular shape, the terminal parts of the segments 90 may thus slide in these segments, said terminal parts being of dimensions slightly smaller than those of the tubes 96,97; the segments are constituted, in their ends, by these sliding elements and, in their central parts, by an element fast therewith having the qualities of flexibility, elasticity and mechanical resistance as offered by a steel plate 98 which may, according to the pressures exerted, curve in one direction or the other in reversible manner.

The very simple control mechanism governs springs, springs 91 acting in the axis of these segments, springs 92,93 perpendicularly and, for these latter, antagonistically. A lever 94 controls at the same time the compression or relaxation of the three springs 91, 92 and 93. This lever, shown in FIG. 36, is mounted to rotate on a central axis and it comprises, internally, a shaft or catch coaxially fast with the articulation 76 between the small rod 77 and the triangular connection assembly 78; the triangular assembly is pivoted by its apex 76 on the rod 77 and its two base angles 79,79' are fast with a plate 100, 100' on which the springs 72 and 73 respectively abut.

The small rod 77 is itself pivoted on a piston 101 serving as support plate for the spring 91 and reverberating the thrust of this spring 91 on the end 90 of the blade 98.

It will be understood that the rotation of the control lever 94 allows passage of the pivot axis 76 successively from the high position 104 corresponding to the position of the mechanism as shown in FIG. 33, to the intermediate position 105, corresponding to the position of the mechanism as shown in FIG. 34, and finally to the low position 106 corresponding to the position of the mechanism as shown in FIG. 35.

In the position shown in FIG. 33 the spring 93 is compressed and no longer exerts its perpendicular action on the flexible segment 98, the spring 92 is relaxed and therefore exerts its perpendicular force, whilst the spring 91, also relaxed, compresses the segment in the longitudinal direction. This results in a flexion in the direction of thrust of the spring 92: an upward convexity in FIG. 33. When the lever is slid into the intermediate position, it compresses the three springs substantially equally, hence the release of the segment 98 of which the median curvature tends to be annulled whilst its end parts slide in slides 96. When action continues in the same direction on the lever until it is brought to low position 106, the spring 92 is compressed and the springs 91 and 93 are relaxed: this results in an inversion of the original curvature.

I claim:

1. Relaxing furniture, such as a piece of garden or beach furniture, comprising a reversible couch provided with two opposite rest surfaces, the first of which allows a comfortable ventral decubitus, and in a zone situated substantially in the upper part of its middle third is provided with a swell which supports the periumbilical and subumbilical zones in a manner such that when a user lies face downwardly thereon said first rest surface gives a kyphosis curvature to the spinal column of said user in the region of the lumbar vertebrae, the second of said rest surface being provided with a depressed zone which is complementary to the swell in said first surface to provide the user with a comfortable dorsal decubitus in a manner such that when said user lies face upwardly on said second rest surface said lumbar vertebrae region is also given a kyphosis curvature.

2. Relaxing furniture in accordance with claim 1, comprising a base, a rest surface pivoted by one end to said base, and at least one means of connection between the base and said rest surface, which is adapted to permit the regulation of the inclination of the rest surface with respect to the base.

3. Relaxing furniture in accordance with one of claims 1 or 2, wherein the rest surface of the body is covered with a mattress consisting of a supple and elastically deformable material and wherein the mattress consists, at least in the zone of the rest surface provided with a swell, of a plurality of elements forming parallel cushions disposed transversely with respect to the longitudinal axis of the furniture.

4. Relaxing furniture in accordance with claim 1, wherein the rest surface consists of a rigid substantially rectangular framework associated with a surface of supple material, stretched on the edges of the framework, each of the longitudinal members of the framework comprising an upward convex curvature situated substantially in the upper part of its middle third.

5. Relaxing furniture in accordance with any one of claims 1, 2 or 4, wherein the two parts of the rest surface situated on either side of the swell, are not situated in the same plane.

6. Relaxing furniture in accordance with any one of claims 1, 2 or 4, wherein the rest surface comprises an aperture near its upper end, which is adapted to receive the face and permits a frontal support of the head.

7. Relaxing furniture in accordance with claim 4, wherein the longitudinal members of the framework of the rest surface are flexible, enabling the user to change the curve of the surface for decubitus, as desired.

8. Relaxing furniture in accordance with any one of claims 1, 2 or 4, wherein the rest surface comprises a transversal pivot between the swell and at least one of its end parts.

9. Relaxing furniture in accordance with one of claims 1 or 2, wherein the face of the rest surface opposite said swell presents a hollow zone complementary of said swell, and this furniture comprises means enabling the surface to be turned over so as to allow its use for the dorsal decubitus, the concavity of said hollow zone then facing upwardly.

10. Relaxing furniture in accordance with claim 9, wherein the rest surface is pivoted by a transverse end on a rigid frame forming support base, the frame being provided with a peripheral dimension slightly greater than that of the rest surface, and adapted to be inserted inside said frame and to be pivoted respectively on one side and the other of said frame, this pivoting enabling the concave face and the convex face, respectively, of said rest surface to be placed in active position, facing upwardly.

11. Relaxing furniture in accordance with claim 9, wherein the faces of the rest surface corresponding respectively to the ventral decubitus and to the dorsal decubitus, are not parallel in their upper parts and diverge from each other.

12. Relaxing furniture in accordance with any one of the claims 10 or 11, wherein the decubitus surface, respectively concave and convex, is constituted in its median part of a flexible and deformable material, capable of presenting an incurvation successively upwardly and downwardly by deformation of said surface, the assembly comprising a mechanism controlling the reversibility of the curve of said surface, this mechanism being adapted to exert a pressure successively on the upper face and the lower face of said deformable surface, provoking the convex or concave form of said surface.

13. Relaxing furniture in accordance with claim 10, wherein the faces of the rest surface corresponding respectively to the ventral decubitus and to the dorsal decubitus, are not parallel in their upper parts and diverge from each other.

14. Relaxing furniture in accordance with claim 9, wherein the decubitus surface, respectively concave and convex, is constituted in its median part of a flexible and deformable material, capable of presenting an incurvation successively upwardly and downwardly by deformation of said surface, the assembly comprising a mechanism controlling the reversibility of the curve of said surface, this mechanism being adapted to exert a pressure successively on the upper face and the lower face of said deformable surface, provoking the convex or concave form of said surface.

* * * * *